US005201701A

United States Patent [19]

Roettger et al.

[11] Patent Number: 5,201,701

[45] Date of Patent: Apr. 13, 1993

[54] ADJUSTABLE FOLDING CYLINDER SYSTEM

[75] Inventors: Heinz Roettger, Aystetten; Michael Neher, Frankfurt am Main, both of Fed. Rep. of Germany

[73] Assignee: MAN Roland Druckmaschinen AG, Offenbach am Main, Fed. Rep. of Germany

[21] Appl. No.: 822,345

[22] Filed: Jan. 17, 1992

[30] Foreign Application Priority Data

Feb. 2, 1991 [DE] Fed. Rep. of Germany .... 4103160.1

[51] Int. Cl.[5] ..... B65H 45/16; B41F 13/62

[52] U.S. Cl. ..... 493/425; 493/428; 493/432; 493/476

[58] Field of Search ..... 493/424, 425, 426, 427, 493/428, 429, 430, 431, 432, 433, 476

[56] References Cited

U.S. PATENT DOCUMENTS 4,437,855 3/1984 Bullen ..... 493/427
4,936,561 6/1990 Mukai ..... 493/476

FOREIGN PATENT DOCUMENTS 3821442 1/1989 Fed. Rep. of Germany .
3838314 5/1990 Fed. Rep. of Germany .

*Primary Examiner*—William E. Terrell

*Attorney, Agent, or Firm*—Frishauf, Holtz, Goodman & Woodward

[57] ABSTRACT

To provide close coupling between movable elements, such as segments (18) capable of varying the effective diameter of a folding blade cylinder (2) or a movable jaw (38) of a folding jaw cylinder, a first gear gear element (21, 47) is coupled via a positioning spindle (20, 43) to the respective movable element (18, 38); a second gear element (22) is coupled to the spindle (20, 43) and further rotationally coupled to the cylinder shaft (11, 35). A positioning or adjustment gearing, for example a differential, or a planetary gearing is positioned in close vicinity to a side wall of the machine, facing the respective cylinder, the positioning gearing being operable to be controlled to change the relative angular relationship between input or received rotation and output or delivered rotation, and being coupled to the second gear element (22), to receive rotation therefrom and further to the first gear element to deliver rotation and additional adjustment movement thereto. The adjusting gearing, which superimposed adjusting or positioning movement, is controlled by a positioning control element, such as a hand wheel (not shown), or a remote positioning control motor (30) coupled thereto by a gear, and controlled, for example, by a suitable electrical-electronic control unit, which can receive input data relating adjusting movement to, for example thickness of paper products being folded, number of paper products in a stack, and the like.

19 Claims, 4 Drawing Sheets

ADJUSTABLE FOLDING CYLINDER SYSTEM

FIELD OF THE INVENTION

The present invention relates to accessory apparatus for use with printing machines, and more particularly to a folding cylinder system which is adjustable to accommodate, selectively and as desired, one or more or a thicker stack of sheets to be folded together.

BACKGROUND

It is frequently necessary to utilize an existing folding system, using folding cylinders with varying numbers of sheets to be folded, in dependence on specific printing jobs. The German Patent Disclosure Document DE 38 38 314, Michalik, discloses a folding jaw and folding blade cylinder combination, which has an arrangement to adjust the spacing of the folding jaws, to thereby accommodate different numbers of sheets to be folded. The folding jaw cylinder has a cylinder shaft with a carrier arrangement formed of two carrier disks. The carrier disks support a movable folding jaw row; two further carrier disks carry fixed folding jaw rows. The carrier disks are suitably journalled in side plates or side frames of the folding apparatus. The carrier disks can be pivoted about the cylinder shaft by interposed slide bearings. They can be secured to the cylinder shaft by clutches. The cylinder shaft has an axial bore extending about one-third df its length, and a radial bore emanating therefrom. The two bores receive positioning shafts and an associated positioning spindle which are coupled by suitable bevel gears with a drive wheel of the folding jaw cylinder and with adjustment carriers, located in the carrier or support disks. A drive gear is driven by a positioning motor. The positioning motor receives positioning commands in the form of electrical signals, supplied thereto by a three-step controller. The three-step controller is coupled to a command input which permits introduction of input values representative of paper thickness, and further to a feedback sensor which measures the thickness of a paper web or paper web assembly.

It has been found that the arrangement has difficulties in operation since the positioning drive is remote from the positioned element, namely the folding jaws. In order to transfer positioning movement, a plurality of transmission elements must be used, such as gear belts, sprockets in engagement therewith, spindles, bevel gears and the like. The control must be accurate and reflect the input signals, so that all these transmission elements must be accurately constructed with as little play as possible. An additional difficulty arises due to the bore in the drive shaft, which is subjected to high loading. The drive shaft of the folding jaw cylinder is mechanically weakened by this bore, which impairs its long-time stability.

THE INVENTION

It is an object to improve a folding apparatus in which the adjustment elements, such as segments or jaws, can be selectively changed, and in which a positioning drive is provided which is located in the immediate vicinity of the element which is to be adjusted or repositioned, e.g. one of the two jaws, typically the movable jaw of the folding jaw cylinder or circumferential segments.

Briefly, a positioning spindle is coupled to a first gear element and to a movable element of the folding mechanism. The movable element may be a circumferential segment or a movable folding jaw of a folding jaw cylinder. The positioning spindle has a second gear element coupled thereto, the second gear element being rotationally coupled to the cylinder shaft driving the unit. A positioning gearing is provided which is located in close vicinity to the bearings and located at the side wall facing the cylinder. The positioning gearing is capable of being controlled to change the relative angular relationship between an input or received rotation, and an output or delivered rotation. It may, for example, be in form of a customary differential or a planetary gearing. The positioning gearing receives rotary movement from the second gear element and is, additionally, rotationally coupled to the first gear element to deliver rotary movement to the first gear element and, in addition thereto, such adjustment movement as is commanded by the positioning or angular deviation of the positioning gearing. A position control means, such as a computer or an electronic controller and motors are coupled to the positioning gearing to adjust this angular relationship and additionally impart positioning movement thereto. The structural elements of the positioning control arrangement, for example positioning motors and the like, can be located outside of the side wall, so that the input positioning movement and the output therefrom are separated from each other effectively only by the thickness of the side wall or frame of the machine.

DRAWINGS

DETAILED DESCRIPTION

Figure 1:
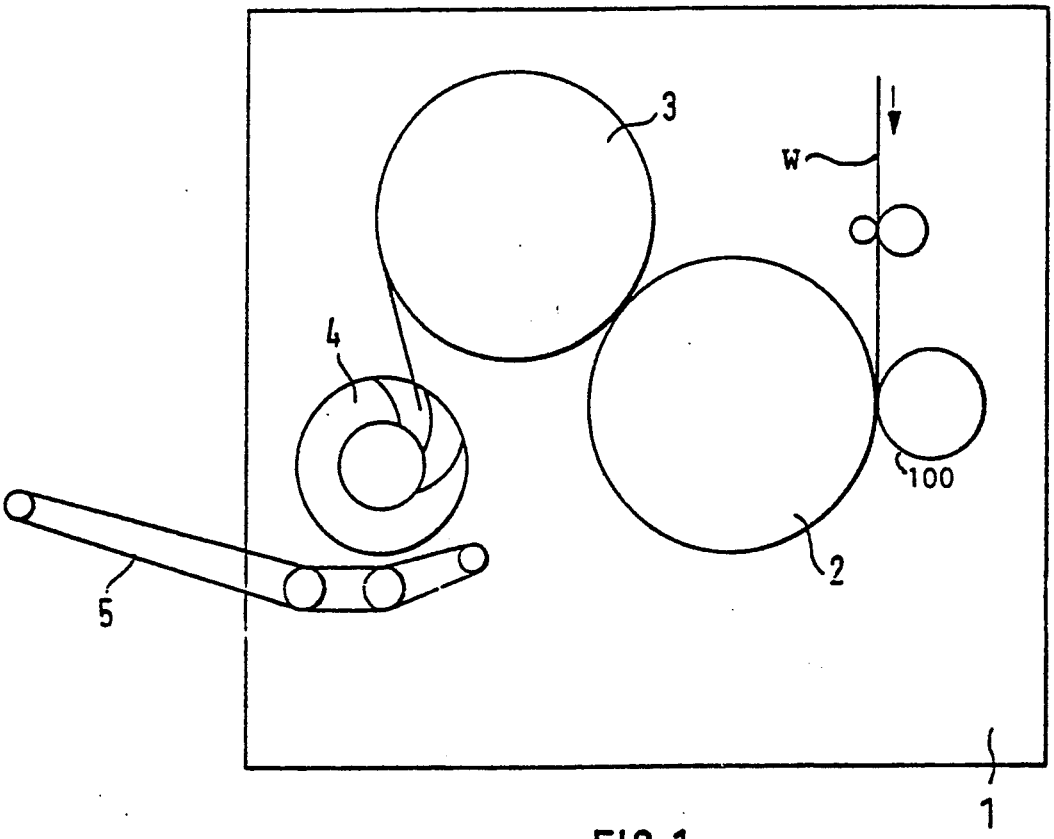
FIG. 1 is a highly schematic side view of a folding apparatus, illustrating only the most important features of a folding arrangement.

Referring first to FIG. 1, which is a highly simplified schematic view illustrating only those elements necessary for an understanding of the present invention, of a folding apparatus 1 having a collection and folding blade cylinder 2 which is in operative engagement with a folding jaw cylinder 3. The folding blade cylinder 2 and the folding jaw cylinder 3, together, are referred to as folding system cylinders. Folded sheets are feed to a paddle wheel distributor 4, which distributes the folded sheets, which may be bundles of folded sheets, on a transport and delivery belt system 5.

The folding system receives, typically from the printing machine, a web W which is guided between suitable guide rollers to the folding blade-and-collection cylinder 2. Only a single web W is shown, although, of course, a plurality of webs, collectively shown by the single line W, can be fed to the cylinder 2. A cutter cylinder 100 severs the web or superposed layers of webs into individual sheets, which are retained on the collection cylinder 2, to be folded thereby in cooperation with the folding jaw cylinder 3. The single or multi-ply web W may already have a longitudinal fold.

Figure 2:
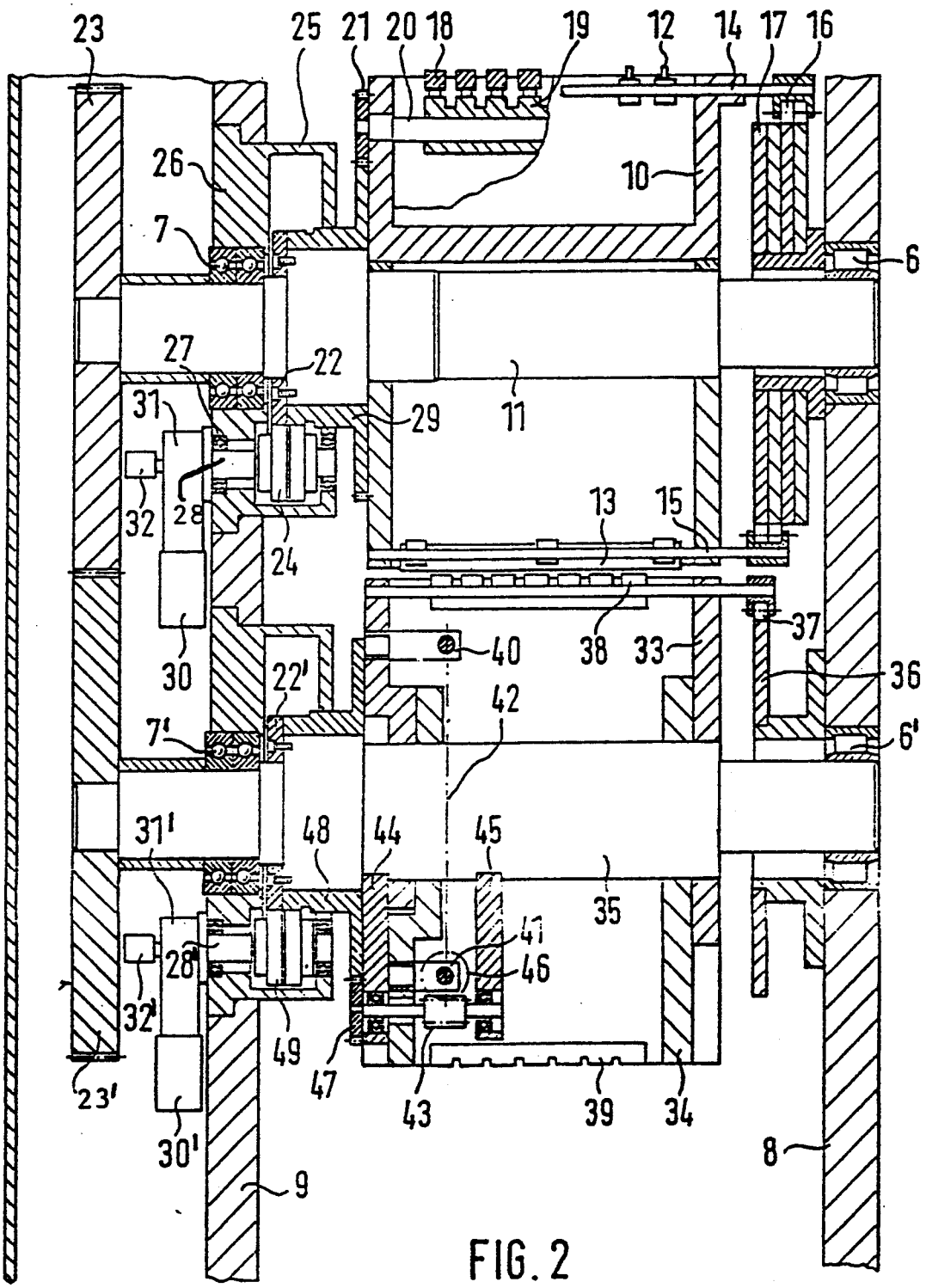
FIG. 2 is a schematic detailed longitudinal sectional view through the folding apparatus of FIG. 1, in which the folding blade and folding jaw cylinders are shown above each other for simplicity of illustration.

FIG. 2 is a longitudinal cross-sectional view through the folding system 1. The collection-and-folding cylinder 2 and the folding jaw cylinder 3 are retained by bearings 6, 7 in side walls or frames 8, 9 of the system 1. The cylinder 2 has a base body 10 which is retained on the shaft 11, and rotatably supported in bearings 6, 7 in the side walls 8, 9. The base body 10 carries needle systems 12 and folding blade systems 13. Torsion rods 14, 15 couple the needle system 12 and the folding blade system 13, respectively with cam follower rollers 16, which are in engagement with rotating cam disks 17. The collection-and-folding blade cylinder 2 carries part-circular segments 18 located at its circumference, which are secured to a segment carrier 19. The segment carrier 19 is secured in the interior of the base body 10 by a positioning spindle 20 which is eccentrically rotationally retained in the base body and passes through the segment carrier 19. The positioning spindle 20 is secured to a gear 21, for rotation therewith, located outside of the base body, the gear 21 transmitting positioning movement to increase or decrease the diameter of the collection-and-folding cylinder 2.

In accordance with a feature of the invention, change of the diameter of the collection-and-folding cylinder 2, by changing the position of the segments 18, is effected in this manner:

A drive gear 22 is secured to the cylinder shaft 11 to rotate therewith. The drive gear 22, thus, rotates in synchronism at the same speed as the shaft 11. A further gear 23 is coupled to the shaft 11. The drive gear 22 transfers its rotary movement on a positioning gearing 24. In accordance with a feature of the invention, the positioning gearing 24 is located closely adjacent the end face of the body 10. The positioning gearing 24 is a differential gear, or planetary gear having, as is well known and customary, a rotation receiving input element, a rotation delivering output element, and a control input which can change the phase angle of rotation between the input and output elements. Gearing 24 is positioned in the interior of a bearing housing 25, which is secured to the side wall or side frame 9 at that side which faces the body 10. The bearing housing 25 has a housing wall 26 which extends into the side wall 9. The wall 26 retains a ball bearing 7 and further a bearing, for example a sleeve bearing or a roller bearing 27 in which a shaft 28 is journalled. The shaft 28 is coupled to the input or rotation receiving side or end of the positioning gearing 24.

The output side or delivery end of the positioning gearing 24 is coupled to a gear 29 which is coaxial with respect to the shaft 11, but rotatable with respect thereto, and which is in engagement with the gear 21. Gear 21, of course, rotates the positioning spindle 20 on which the segment carriers 19 are located.

The gear 21 forms a first gear element, gear 22 a second gear element and gear 29 a third gear element of a gear train which, in dependence on the particular construction of the positioning gearing 28, could also be constructed in different manner. For example, a rotation transmission from the positioning gearing 24 to the gear 21 could be formed by placing a bevel gear at the end of the shaft projecting from the positioning gearing 24, a bevel gear in lieu of the gear 21, and a transfer shaft with two bevel gears, in which the transfer shaft is perpendicular to the cylinder shaft 11. The arrangement as illustrated in FIG. 2 is preferred; in this embodiment, the transmission ratio between the drive gear 22 and the gear 29 is 1:1. Consequently, the base body 10, driven by the cylinder shaft 11 and the gear 29, operate in synchronism.

Adjusting operation

If it is desired to change the diameter of the collection-and-folding cylinder 2, be it an increase or a decrease of the diameter, relative movement between the drive gear 22 and the gear 29 must be obtained. This relative movement can be commanded when the cylinder 2 is stationary or when it rotates. The relative movement is controlled by adjusting the positioning gearing 24.

To adjust the positioning gearing, a hand wheel not shown coupled to shaft 28 can be rotated. Alternatively, or as illustrated in a preferred form in FIG. 2, the shaft 28 is rotated by a positioning motor 30 under control of an electrical signal. Motor 30 is coupled to the shaft 28 through a gearing 31.

Rotating the motor 30 in the one or the other direction causes rotation of the shaft 28 and, at the output or delivery side of the positioning gearing, a corresponding relative or superposed rotary movement of the gear 29, independently of the rotation of the cylinder shaft 11. This relative rotary movement of the gear 29 with respect to the base body is transferred to the gear 21, which then so adjusts the eccentric spindle 20 that the segments 18 are repositioned as desired and thus change the effective diameter of the collection-and-folding cylinder 2. In accordance with the direction of rotation of the positioning motor 30, the diameter will decrease, or increase. Gear 23 can receive input power from the machine drive.

Changing the position of the segments 18, by rotation of the motor 30 can be remotely controlled.

Figure 4:
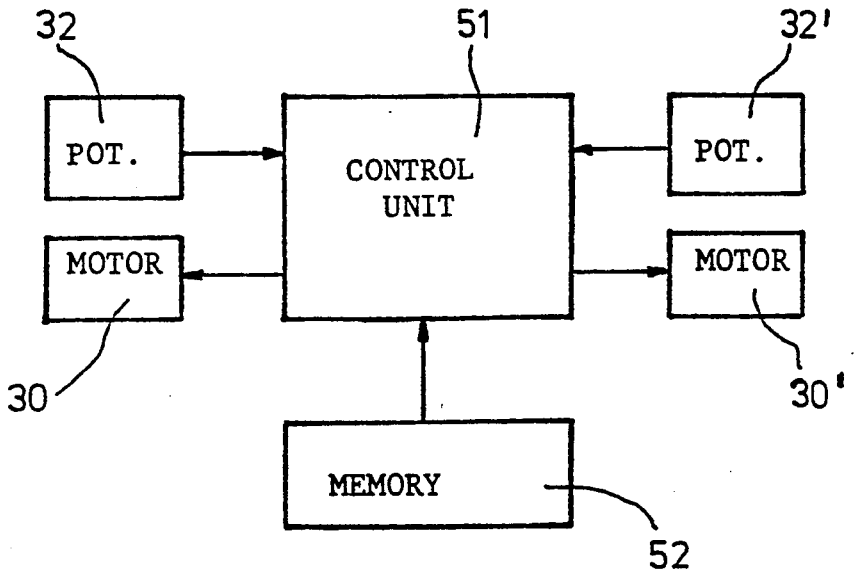
FIG. 4 is a schematic block diagram of the electrical control arrangement to control positioning of the movable element of the folding apparatus.

Referring to FIG. 4, which shows an automatic or remote-control positioning system:

A control unit 51, which may be part of a printing machine control panel, is coupled to a data memory 52, in which the relationship of position of the segments 18, that is, the effective diameter of the cylinder 2 with respect to production requirements which frequently recur can be stored. Each diametrical dimension will be associated with a certain angular position of the positioning spindle 20. Upon change of production, for example for a printing job having a larger number of sheets to be folded together, or for different weight of paper, the motor 30 is activated by a suitable control circuit within the control unit 51, not shown and known by and itself, which generates a control signal for the positioning motor 30 by comparing the actual value of the rotary angle of the spindle 20 with a command value determined or derived from the memory 52. The input shaft 28 to the gear 24 is coupled to a position transducer 32, for example a potentiometer or the like, which provides an output signal of the instantaneous position of the gearing 24, and hence of gear 21 and spindle 20; when the signal from the feedback transducer 32 and the signal from the control unit 51 to the motor 30 are equal, the motor is disconnected and the positioning gearing 24 is properly adjusted.

The positioning gearing 24 can be constructed in accordance with any well known adjustable gearing and, in its simplest form, the folding system in accordance with the present invention utilizes a differential gearing. The essential characteristics thereof are the concentric arrangement of the transmission element as well as of the adjustable elements which can result in a closed, compact unit with high gear ratio. Rather than using a concentric differential gearing, a planetary drive can be used. A planetary drive, preferably, is so constructed that the motor 30 or a manual control wheel positions the planet carrier, so that relative rotary movement of the sun gear with respect to the ring gear will obtain.

The folding jaw cylinder has two base body portions; a first base body portion 33 and a second base body portion 34 are both secured to a cylinder shaft 35, and rotatably retained in the side walls or side frames 8, 9 of the folding system by suitable bearings 6', 7'.

Parts and elements which are similar to those already described have been given the same reference numerals, with prime notation.

A control disk 36 and a control disk 37, respectively, control the folding jaws 38, located on the base body portion 33. The second base body portion 34 retains fixed folding jaw elements 39, that is, uncontrolled jaw elements. The first and second base body portions 33, 34 are rotatably located on the cylinder shaft 35 so that they can be positioned relative to each other. This repositioning is obtained by a first guide bolt 40, secured in the body portion 33, and a second guide bolt 41, secured to the second base body portion 34. A threaded spindle 42 connects the guide bolts 40 and 41. The spindle 42 is rotatably retained in a bearing block 50, secured for rotation with the shaft 35. The threaded spindle 42 is rotated, as well known, by a positioning spindle 43 formed as a worm, which, in turn, is secured in bearing blocks 44, 45, rotating with the cylinder shaft 35. A worm wheel 46 is in engagement with the spindle 43 see also FIG. 3.

The worm shaft 43 is rotated, selectively, in clockwise or counterclockwise direction by a gear 47, in engagement with the gear 48. The gear 48 is located on the cylinder shaft 35, coaxially therewith, and can be rotated by the positioning gearing 49 with respect to the cylinder shaft 35. The positioning gearing 49, essentially, corresponds to the positioning gearing 24, and may, indeed, be an identical element. Rotary movement is introduced into the positioning gearing 49 in the one or the other direction in the same manner as to the gearing 24 - FIG. 2. The adjusting movement of the folding jaws, thus, is controlled similarly as the diameter change adjustment in the collection-and-folding cylinder 2. The identical reference numerals, with prime notation, are referred to.

Figure 3:
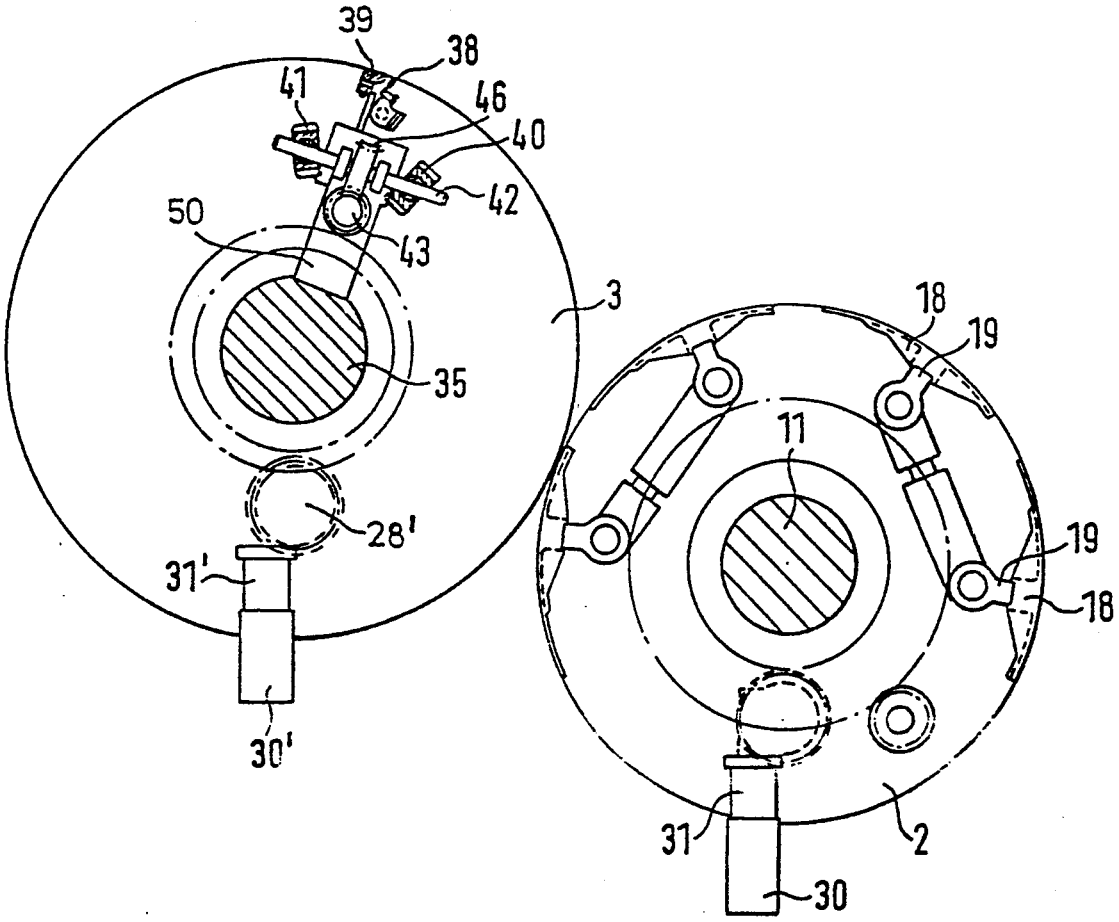
FIG. 3 is a cross-sectional view through the apparatus of FIG. 2, and omitting all components not necessary for an understanding of the explanation in connection with FIG. 3.

FIG. 3 illustrates a cross section through the folding apparatus of FIG. 2, from which all elements not necessary for an understanding of the operation have been omitted. Only two segment carriers with two segments are shown in the cylinder 2, for simplicity; the arrangement of folding jaws 38 and 39, as well as the associated adjustment elements 40 to 44, can be seen; the position of the respective positioning motors 30 for the cylinders 2, 3, likewise, is illustrated.

The folding system, which has one or more folding system cylinders with respectively adjustable components or elements, has substantial advantages, namely:

The adjusting or positioning gearing 24, 29 is interiorly of the system, that is, between the side walls or side frames of the folding system, and hence between the bearings of the respective cylinders. This permits use of standard cylinder bearings, eliminates any special construction of cylinder bearings, and most importantly, eliminates any axial bores of the cylinder shaft in order to place the adjustment elements therein.

The positioning or adjustment gearing is in the immediate vicinity of the element to be adjusted, so that only a short rotation transmitting system or gear train is needed.

The short gear or motion transmitting train is simple, requires only a minimum number of elements, and permits, thus, transmission of motion essentially without play; the positioning drive can be readily placed on existing machines without changing the cylinder position of the machines; the only requirements are matching the dimensions of the elements to available space; thus, only dimensional considerations and consideration of required rotary force or torque need be considered, without otherwise changing existing cylinder adjustment arrangements which, on the cylinders themselves, can be of standard construction.

Various changes and modifications may be made, and any features described herein may be used with any others, within the scope of the concept of the present invention.

We claim:

1. Adjustable folding apparatus having two side frames or walls (8, 9), each defining an inward side facing the other frame or wall and an outward side remote from the inward side;

at least one folding cylinder (2, 3);

the at least one folding cylinder including a cylinder shaft (11, 35);

bearing means (6, 7) rotatably retaining said shaft in each of said side walls or frames;

a base body (10; 33, 34) concentrically secured to the cylinder shaft;

movable, elements (18, 38) mounted on the base body and controllably movable with respect thereto;

a positioning spindle (20, 43) operably coupled to the movable element (18, 38), rotatably retained within the base body and extending parallel to the axis of the base body (10, 33, 34);

a first gear element (21, 47) coupled to the positioning spindle (20, 43);

a second gear element (22) located on the cylinder shaft (11, 35) for rotation therewith;

a positioning or adjusting gearing (24, 49) having a rotation input coupled to said second gear element (22) to receive rotary movement form the second gear element, said positioning or adjusting gearing having a rotation output providing delivered rotation, said output being coupled (29) to said first gear element (21, 47) to deliver rotary movement to said first gear element and hence to the positioning spindle (20, 43) and further providing additional adjustment or positioning movement thereto; and position control means (28, 30, 31) coupled to a positioning and control input of said positioning and adjusting gearing (49) for imparting an additional or superimposed positioning movement thereto, said positioning or adjusting gearing (24, 49) being operable to change the relative angular relationship between the input rotation received at said rotation input from said second gear element and the output, or delivered rotation, wherein said positioning or adjusting gearing (24, 49) is located at the inward side of one (9) of the side frame of walls (8, 9) and positioned in close vicinity to that one (7) of said bearing means located on said one (9) or the side frames of walls (8, 9); and wherein said position control means (28, 30, 31) is located immediately adjacent said positioning or adjusting gearing (24, 49) on said one side wall (9).

2. The apparatus of claim 1, wherein folding cylinder comprises a collection-and-folding blade cylinder (2);

said movable elements comprise curved segments (18) adjustable to thereby change the effective diameter of the collection-and-folding blade cylinder (2);

and a segment carrier (19) secured to the base body (10) and movable with respect thereto, said segment carrier supporting said segments and positioning said segments.

3. The apparatus of claim 2, wherein said position control means (30, 31) is located at the outward side of said one side wall (9), and a control shaft (28) is provided, rotatably passing through said one side wall (9), and connecting the position control means (30, 31) to said positioning or adjusting gearing (24, 49).

4. The apparatus of claim 1, wherein said folding cylinder comprises a folding jaw cylinder (3), and said movable elements (38) comprise controllable folding jaws of the folding jaw cylinder; and wherein said folding jaw cylinder further includes fixed folding jaw elements (39) positioned for cooperation with said movable jaws (38) on said folding jaw cylinder (3).

5. The apparatus of claim 4, wherein said positioning spindle (43) at least in part, comprises a worm shaft, rotatable therewith, and, in turn, being coupled to the movable elements (38).

6. The apparatus of claim 4, wherein said position control means (30, 31) is located at the outward side of said one side wall (9), and a control shaft (28) is provided, rotatably passing through said one side wall (9), and connecting the position control means (30, 31) to said positioning or adjusting gearing (24, 49).

7. The apparatus of claim 1, wherein the second gear element (22) comprises a gear concentrically located on the cylinder shaft (11, 35) and coupled thereto for rotation therewith.

8. The apparatus of claim 1, wherein the position control means comprises a positioning motor and a gearing (31) coupled to the motor.

9. The apparatus of claim 1, wherein the gearing coupled to the motor has two output shaft means, one rotationally coupled to said positioning and adjusting gearing (24, 49); and a shaft position transducer (32) is provided, coupled to a second one of said output shaft means.

10. The apparatus of claim 1, wherein the position control means comprises electric motor means (30);

said apparatus further including a control unit (51) controlling said motor means; and a memory (52) storing positioning and adjusting values, said memory being coupled to said control unit for controlling the motor means in accordance with stored adjustment or positioning values.

11. The apparatus of claim 1, wherein said position control means (30, 31) is located at the outward side of said one side wall (9); and a control shaft (28) is provided, rotatably passing through said one side wall (9), and connecting the position control means (30, 31) to said positioning or adjusting gearing (24, 49).

12. The apparatus of claim 11, wherein the position control means comprises a positioning motor and a gearing (31) coupled to the motor.

13. The apparatus of claim 1, wherein said second gear element (22) is in direct gearing engagement with the positioning or adjusting gearing (24, 49); and wherein said positioning or adjusting gearing (24, 49) is positioned immediately adjacent said one (7) of said bearing means (6, 7).

14. The apparatus of claim 13, further including a single coupling gear (29) rotatably seated on said cylinder shaft (11) inwardly of said one (9) of the side frames or walls (8, 9), and in gearing engagement with said first gear element (21, 47), which is coupled to the positioning spindle (20, 43)

and further in gearing engagement with the rotation output of said positioning or adjusting gearing (24, 49) for transmission of adjusted rotation to said adjustment spindle.

15. The apparatus of claim 14, wherein said position control means (30, 31) is located at the outward side of said one side wall (9), and a control shaft (28) is provided, rotatably passing through said one side wall (9), and connecting the position control means (30, 31) to said positioning or adjusting gearing (24, 49).

16. The apparatus of claim 15, further including a main drive gear (23, 23') directly coupled to the cylinder shaft (11, 35) to provide rotary drive for the at least one folding cylinder (2, 3), the positioning or adjusting gearing (24, 49) and the first gear element (21, 47).

17. The apparatus of claim 13, wherein said position control means (30, 31) is located at the outward side of said one side wall (9), and a control shaft (28) is provided, rotatably passing through said one side wall (9), and connecting the position control means (30, 31) to said positioning or adjusting gearing (24, 49).

18. The apparatus of claim 1, further including a single coupling gear (29) rotatably seated on said cylinder shaft (11) inwardly of said one (9) of the side frames or walls (8, 9), and in gearing engagement with said first gear element (21, 48), which is coupled to the positioning spindle (20, 43)

and further in gearing engagement with the rotation output of said positioning or adjusting gearing (24, 49) for transmission of adjusted rotation to said adjustment spindle.

19. The apparatus of claim 18, wherein said position control means (30, 31) is located at the outward side of said one side wall (9), and a control shaft (28) is provided, rotatably passing through said one side wall (9), and connecting the position control means (30, 31) to said positioning or adjusting gearing (24, 49).

* * * * *